United States Patent [19]

Pullen

[11] 4,074,098

[45] Feb. 14, 1978

[54] ELECTRIC ARC EXTINCTION APPARATUS

[75] Inventor: Albert Pullen, Bergentheim, Netherlands

[73] Assignee: Hazemeijer B.V., Hengelo, Netherlands

[21] Appl. No.: 670,672

[22] Filed: Mar. 26, 1976

[51] Int. Cl.[2] ..... H01H 33/16

[52] U.S. Cl. ..... 200/144 R; 200/144 AP; 200/147 R; 200/149 A

[58] Field of Search ..... 200/147 R, 144 AP, 144 R, 200/149 A

[56] References Cited

U.S. PATENT DOCUMENTS

| | | | |
|---|---|---|---|
| 3,716,685 | 2/1973 | Wilson | 200/144 R |
| 3,728,505 | 4/1973 | McConnell | 200/144 AP |

FOREIGN PATENT DOCUMENTS

| | | | |
|---|---|---|---|
| 1,109,180 | 9/1955 | France | 200/147 R |
| 1,344,727 | 10/1963 | France | 200/147 R |
| 1,195,850 | 7/1965 | Germany | 200/147 R |

*Primary Examiner*—Robert S. Macon
*Attorney, Agent, or Firm*—Watson, Cole, Grindle & Watson

[57] ABSTRACT

In an electric arc extinguishing apparatus, two electrodes are provided for initiation of the electric arc. Two conductors, each respectively connected to one of the electrodes, conduct the electric arc at high velocity under the influence of a magnetic field generated by the current of the arc itself. Movement of the arc along the conductors inserts a continuous electrical impedance in series with the arc. The two conductors are located in a winding channel formed in an arc resistant electrically insulating material such that the adjacent succeeding turns of the conductors are separated by the insulating walls of the channel. The winding channel emerges at one end into an annular channel containing an annular contact gap between the ends of both said conductors.

13 Claims, 4 Drawing Figures

ELECTRIC ARC EXTINCTION APPARATUS

Figure 1:
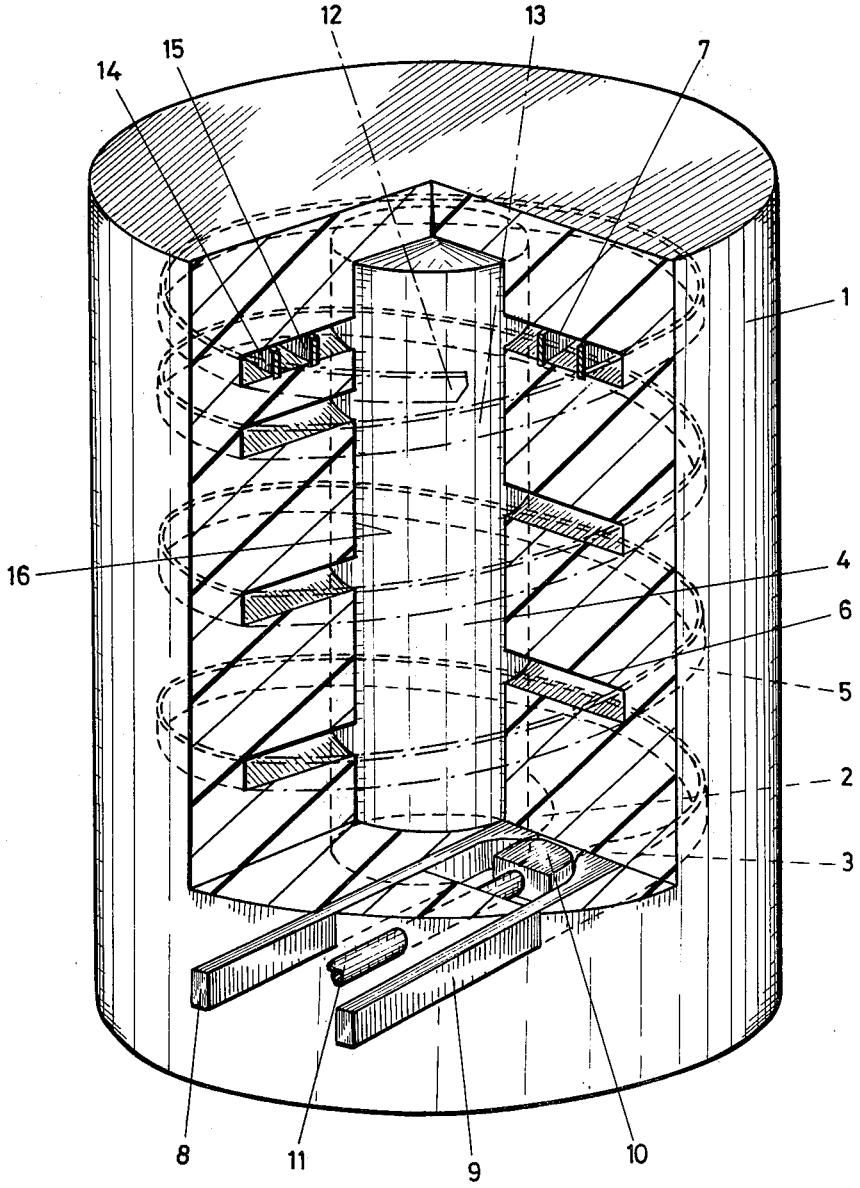

The invention relates to an electric apparatus comprising an arc ignition mechanism having two electrodes, between which an electric arc can be drawn, two conductors connected to the electrodes of the arc ignition mechanism, respectively, along which conductors the electric arc initiated between said electrodes can be moved with high velocity under the influence of a magnetic field generated by the supply current of the arc, whereby electric resistance and/or self-inductance is connected in series with the arc, said apparatus furthermore comprising an annular contact gap connected to the ends of both conductors to keep the arc, which has been weakened in the mean time, rotating until its definite extinction. Such apparatus is disclosed in U.S. Pat. No. 3,728,505.

The known apparatus comprises two cooperating contacts, which are inserted into an electric circuit. Two helical arc conductors or runners are respectively connected to the two contacts, the one arc conductor being embedded into the inner wall of an insulating cylinder, and the second conductor being applied to the surface of an insulating pin, which is coaxially positioned to the insulating cylinder. Both helical conductors end at an annular contact, respectively, and between said annular contacts an annular contact gap is present.

If the two cooperating contacts are opened, in order to interrupt the electric current in the circuit connected to the contacts, an arc is drawn between the two contacts, which is transferred to the beginning of the two helical conductors by means of a flow of extinction gas. Under the influence of the axial magnetic field, which is produced by the turns of the two conductors, which carry the current to be interrupted, a transverse force is exerted on the arc, so that it will rotate and will be moved between the two helical conductors, so that gradually more turns are connected. Thereby the arc will be displaced with high velocity towards the ends of the two conductors, and finally it reaches the two annular contacts between which it maintains rotating until its definite extinction.

The two helical conductors may be made of resistance material, so that during the arc movement along said conductors more and more electric resistance is inserted into the circuit, whereby the arc voltage is reduced and the arc is weakened, which is necessary for its definite extinction.

Since the arc during its climbing motion between the two helical conductors is constantly blown at in transverse direction by the flow of extinction gas, it is possible that the arc will pass over one or more turns of the helical conductors, and if the electric resistance of the conductors is relatively high, the arc may also step back. If this happens, the electric resistance in the electric circuit to be interrupted does not increase gradually any longer, but rather abruptly or stepwise, which is undesirable. Moreover the necessity of having the axial flow of extinction gas constitutes a complication, which makes the apparatus more expensive and should be avoided preferably.

It is an object of the present invention to eliminate said disadvantages, and accordingly it provides an apparatus of the type described above, characterized in that the electrodes of the arc ignition mechanism and the two conductors are contained in a channel provided in a body of an arc resistant insulating material, said channel at its end emerging into an annular channel in said body containing the annular contact gap.

In the apparatus according to the present invention the arc between the two conductors is continuously located in the channel in the insulating body, so that on the one hand the arc is additionally cooled by the channel walls of insulating material, and on the other hand passing over of parts of the arc conductor is not possible anymore. In this way it is guaranteed that the electric resistance in the electric circuit to be interrupted will gradually increase. Furthermore no transitional problems will arise if the arc is transferred from between the cooperating contact members to the arc conductors, since the contact members are arranged in the same channel as the arc conductors.

A first preferred embodiment of the apparatus according to the present invention is characterized in that the channel in the body of arc resistent insulating material is a helicoidal channel, the end turn whereof is closed in itself and constitutes the annular channel, and in that one conductor is arranged as a pin, whereof the axis coincides with the axis of the helicoidal channel, said pin being embedded in the body of arc resistant insulating material and sealing the helicoidal channel internally, the other conductor being a helicoidal conductor constituting the exterior of said helicoidal channel.

A second preferred embodiment is characterized in that the channel in the body of arc resistant insulating material is a spiral-shaped channel, whereof the end turn is closed in itself and constitutes the annular channel, the two conductors being identical spiral conductors, which are embedded in two opposite walls of the spiral-shaped channel.

Figure 2:
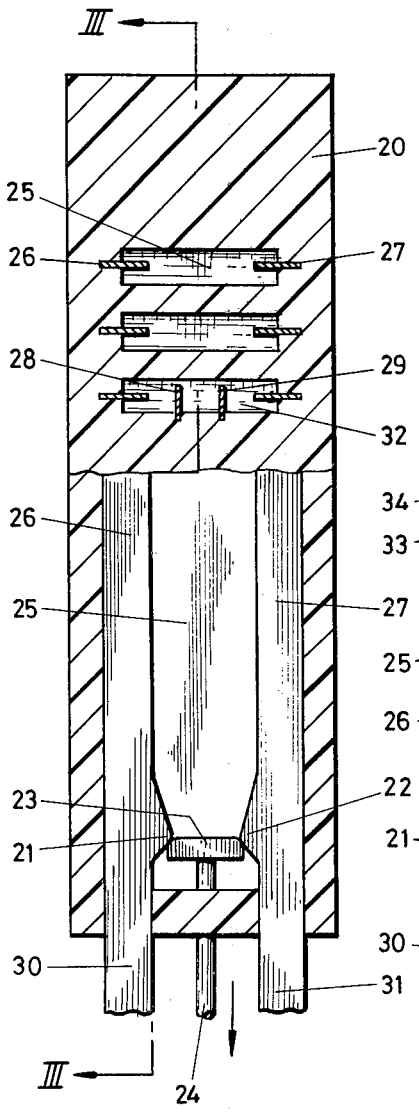
Figure 3:
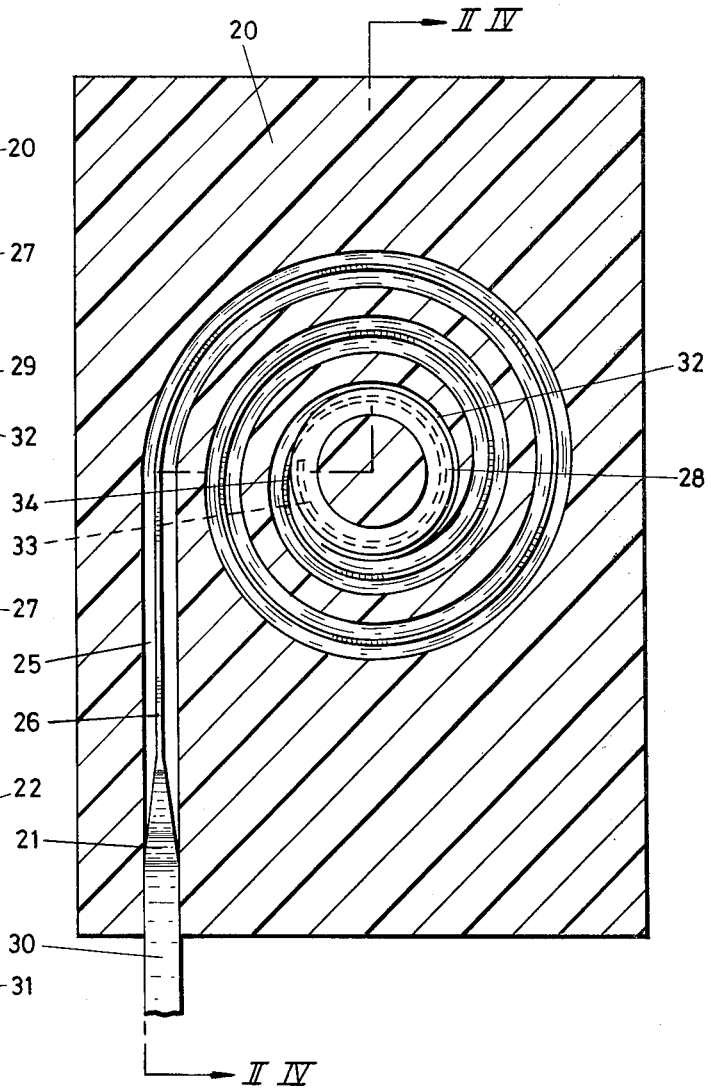
Figure 4:
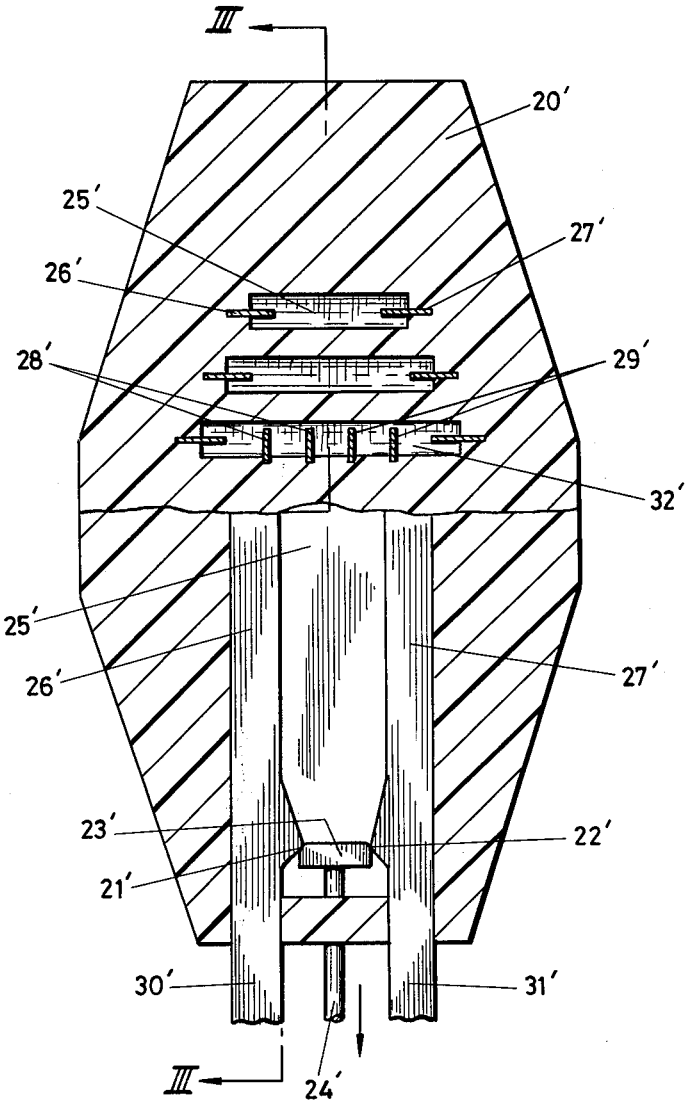

The invention will now be explained further in reference to some embodiments illustrated in the drawing, in which:

FIG. 1 is a perspective view, partly cross-sectioned, of an apparatus according to the present invention having a helical channel, FIG. 2 a cross-section of an apparatus according to the present invention having a spiral-shaped channel, said cross-section being taken according to the line II—II in FIG. 3, FIG. 3 a cross-section according to the line III—III in FIG. 2, FIG. 4 a cross-section according to the line IV—IV in FIG. 3 of an apparatus having a spiral-shaped channel, in which, however, the width of the spiral-shaped channel increases gradually.

Referring to FIG. 1 the arc extinction apparatus according to the present invention comprises a body 1 of an arc resistent insulating material, in which a helical channel 6 is provided. An arc ignition mechanism is provided at the one end of the channel 6, and said mechanism comprises two stationary contacts 2 and 3 and the bridging contact 10, which can be operated by means of the rod 11. The stationary contacts 2 and 3 are provided respectively with external terminal conductors 8 and 9. The conductors 8 and 9 and the operating rod 11 are the only parts of the apparatus, which extend out of the insulating body 1.

The helical channel 6 beginning at the arc ignition mechanism 2, 3, 10, ends in an end turn 7, which is closed in itself and accordingly is of annular form. The helical channel 6 is bounded internally by a pin 4 of conductive material, which at the bottom is electrically connected to the stationary contact 2 and of which the helicoidal portion of the outer surface which is exposed in the helical channel 6 constitutes one of the arc conductors. The other arc conductor has the form of a helical winding 5, constituting the outer wall of the channel 6.

In the annular end turn 7 of the helical shaped channel 6 the helical conductor 5 does not extend completely onto the preceding turn of said conductor, but there is a small spacing between the end 12 of the helical conductor 5 and the position 13 on the preceding turn thereof. Furthermore some de-ionization plates 14, 15 are arranged between the end turn of the conductor 5 in the annular channel 7 and the conductive pin 4, and said plates 14, 15 do not completely close the channel and serve to extend the arc between the end turn and the pin 4, whereby the arc extinction or quenching is promoted.

The apparatus according to FIG. 1 is connected into an electric circuit, in which a predetermined electric current flows, by the terminal leads 8 and 9. In order to interrupt said electric current the movable contact 10 is disengaged from the two stationary contacts 2 and 3 by means of the rod 11, so that an electric arc is drawn between said contacts 2 and 3. Initially the arc is pressed farther into the channel under the influence of the opposite electric currents in the terminal leads 8 and 9, whereby a greater part of the helical conductor 5 is inserted in the electric circuit. Thereby an axial magnetic field is produced, which acts on the arc and whereby said arc rotating through the helical channel 6, is moved upwardly. Thereby more and more resistance is connected into the circuit, i.e., the resistance of the current flown portions of the helical conductor 5 and the pin 4. Finally the arc reaches the end turn of the helical conductor 5 in the annular channel 7, and reaches the end 12 of the conductor 5, and at this end 12 the arc foot concerned can easily jump over towards the position 13 of the preceding turn of the conductor 5. The de-ionization plates 14 and 15 provide an increased quenching effect, so that the arc is quenched very rapidly.

Of course, it is also possible in the apparatus according to FIG. 1 to omit the bridging contact 10 together with the operating rod 11, so that the arc between the stationary contacts 2 and 3 can be initiated by means of a voltage surge between the terminal leads 8 and 9. The apparatus will then function as a surge arrester.

In FIGS. 2 and 3 two cross-sections are shown of a similar apparatus, now provided with a spiral-shaped channel. Again there is provided a body of an arc resistent insulating material 20, comprising a spiral-shaped channel 25. The spiral-shaped channel 25 begins at the two stationary contacts 21 and 22, which can be bridged by the movable contact 23, which is operated by means of the rod 24. The stationary contacts are provided with terminal leads 30 and 31, respectively, which together with the rod 24 are the only components, which extend outwardly out of the body of the insulating material 20.

Two arc conductors 26 and 27 are respectively connected to the two stationary contacts 21 and 22, and the arc conductors are embedded in the smaller walls of the spiral-shaped channel 25. The channel 25 again emerges into an annular channel 32, accommodating the annular contact gap, which is constituted by the two end turns of the conductors 26 and 27. The end turns of the spiral-shaped conductors 26 and 27 are again not closed in itself, but the end 33 thereof is arranged with small spacing from position 34 on the preceding spiral turn. Extinction plates 28, 29 are arranged in the annular channel 32 to provide an additional arc lengthening and arc cooling.

The apparatus according to FIGS. 2 and 3 can be connected into an electric circuit by means of the terminal leads 30 and 31. If the electric circuit is to be interrupted, the bridging contact 23 is pulled downwardly by means of the rod 24, and an electric arc is initiated between the stationary contacts 21 and 22. Said arc will be urged into the channel 25 under the influence of the opposite currents in the terminal leads 30 and 31, and then by the axial magnetic field, which is oriented perpendicularly to the plane of the spirals, and is produced by the arc current flown part of the two spiral-shaped arc conductors, the arc is moved further through the spiral-shaped channel, until the arc reaches a location between the two end turns of the arc conductors 26 and 27. The arc then jumps over from the end 33 towards the position 34 on the preceding turn and keeps rotating until it has been extinguished definitely.

Also in the apparatus having the spiral-shaped arc conductors the movable contact 23 with its operating rod 24 may be omitted, so that the arc between the stationary contacts 21 and 22 has then to be initiated by means of a surge voltage, applied through the terminal leads 30 and 31. Then the apparatus again acts as a spark gap or triggered spark gap.

Finally in FIG. 4 an apparatus is illustrated, which substantially corresponds to the apparatus according to FIG. 2, the only difference being that the spiral-shaped channel 25′ from the outermost turn towards the innermost annular turn 32′ has an increasing width. Thereby the arc on its way towards the innermost annular turn of the channel will become longer, which promotes the arc quenching. In the innermost annular turn 32′ again de-ionization plates 28′ and 29′ are disposed. It is observed that the reference numerals in FIG. 4 are provided with accents, but for the remainder they correspond to the reference numerals in FIGS. 2 and 3 having no accents.

It is possible to provide the channel in the insulating body in the direction of movement of the arc with an increasing width, for instance by giving the pin 4 in FIG. 1 a conical instead of a cylindrical form.

In order to strengthen the axial magnetic field, which causes the arc between the arc conductors to rotate, an iron shell can be arranged about the apparatus, or alternatively the pin 4 in FIG. 1 can be made of iron.

Of course it is also possible to close the end turns of the conductors, so that the spacing between the positions 12 and 13 in FIG. 1 and the spacing between the positions 33 and 34 in FIG. 3 is bridged or short-circuited.

The channel can be filled with an extinction of quenching medium, such as air, SF6, vacuum, oil, etc.

It is also possible that the channel is gas-permeable in axial or radial direction.

It is observed that when the arc currents are relatively low, the annular contact gap in the annular end turn, 7 in FIG. 1; 32 in FIG. 2 and FIG. 3; 32′ in FIG. 4, will not always be reached by the arc, since it has already been quenched on its way between the two arc conductors. In such case the annular end turn of the channel 6, 25 could be omitted.

Although in the embodiments a helical or spiral-shaped channel is described, it is obvious that different channel forms may be used as well. However, to be able to accommodate a long channel in an insulating body of reduced size the channel forms as described are the most favorable.

I claim:

1. An electric arc extinguishing apparatus, comprising:

an arc initiation mechanism including two electrodes for initiation of an electric arc therebetween;

two conductors each respectively connected to one of said electrodes for conducting the electric arc at high velocity under the influence of a magnetic field generated by the supply current of the arc, whereby electric impedance is connected in series with said arc;

an annular contact gap between the ends of both said conductors; and an arc resistant electrically insulating material including a winding channel, said two conductors being located in said winding channel such that the adjacent succeeding turns of said conductors are separated by the insulating walls of said channel, said annular contact gap maintaining the rotation of the arc caused by the wound conductors until said arc is extinguished, said winding channel emerging at one end thereof into an annular channel in said body containing said annular contact gap.

2. Apparatus according to claim 1, wherein said winding channel is a helicoidal channel, the end turn thereof being closed on itself to constitute said annular channel, one conductor being arranged as a pin having an axis coinciding with the axis of the helicoidal channel, said pin being embedded in said body of arc resistant insulating material and sealing the helicoidal channel internally, the other conductor being a helicoidal conductor constituting the exterior of said helicoidal channel.

3. Apparatus according to claim 1 wherein said winding channel is a spiral-shaped channel, the end turn thereof being closed on itself to constitute said annular channel, said two conductors being identical spiral conductors, each being embedded in two opposite walls of said spiral-shaped channel.

4. Apparatus according to claim 1, wherein said winding channel has a varying cross-section in the direction of movement of the arc.

5. Apparatus according to claim 1, wherein said conductors have a varying size in the direction of movement of the arc.

6. Apparatus according to claim 1, wherein the resistance of the conductors per unit length varies in the direction of movement of the arc.

7. Apparatus according to claim 1, wherein said arc ignition mechanism is constituted by two stationary contacts and a movable contact, which is adapted to bridge said stationary contacts.

8. Apparatus according to claim 1, wherein said arc ignition mechanism is constituted by a spark gap comprising two stationary contacts.

9. Apparatus according to claim 1, further comprising de-ionization plates disposed in the channel between the conductors.

10. Apparatus according to claim 1, further comprising an iron shell enclosing the apparatus.

11. Apparatus according to claim 1, further comprising a short circuit winding.

12. Apparatus according to claim 1, wherein said channel is filled with an extinction medium.

13. Apparatus according to claim 1, wherein said channel is pervious to gas in the axial or radial direction.

* * * * *